US006056227A

United States Patent [19]

Feiler et al.

[11] Patent Number: 6,056,227

[45] Date of Patent: May 2, 2000

[54] DEVICE FOR AUTOMATICALLY REPLACING THREAD BOBBINS AND SPOOLING DEVICE WITH REPLACEMENT UNIT

[75] Inventors: Horst Feiler, Göppingen; Klaus Rippstein, Hammelburg, both of Germany

[73] Assignee: Zinser Textilmaschinen GmbH, Ebersbach/Fils, Germany

[21] Appl. No.: 09/171,933

[22] PCT Filed: Apr. 1, 1998

[86] PCT No.: PCT/DE98/00946

§ 371 Date: Oct. 26, 1998

§ 102(e) Date: Oct. 26, 1998

[87] PCT Pub. No.: WO98/45203

PCT Pub. Date: Oct. 15, 1998

[30] Foreign Application Priority Data

| | | | |
|---|---|---|---|
| Apr. 4, 1997 | [DE] | Germany | 197 13 848 |
| Jan. 23, 1998 | [DE] | Germany | 198 02 413 |

[51] Int. Cl.[7] ..... B65H 54/22

[52] U.S. Cl. ..... 242/473.5

[58] Field of Search ..... 242/473.5, 473.4, 242/743.8, 486.2, 488, 474.4, 474.7

[56] References Cited

U.S. PATENT DOCUMENTS

| | | | |
|---|---|---|---|
| Re. 33,111 | 11/1989 | Niederer | 242/473.5 |
| 779,123 | 1/1905 | Fredenburgh | 242/488 X |
| 1,121,103 | 12/1914 | Hooper | 242/488 X |
| 1,700,371 | 1/1929 | Lazenby | 242/473.5 |
| 3,758,925 | 9/1973 | Desaulniers et al. | 242/488 X |
| 3,820,730 | 6/1974 | Endo et al. . | |
| 4,052,017 | 10/1977 | Schar | 242/473.8 |
| 4,108,388 | 8/1978 | Schar | 242/473.8 |
| 4,165,046 | 8/1979 | Suzuki et al. | 242/473.8 |
| 4,572,449 | 2/1986 | Naylor | 242/486.2 |
| 4,638,955 | 1/1987 | Schippers et al. | 242/473.8 |
| 4,844,358 | 7/1989 | Kamp | 242/473.5 X |
| 5,488,753 | 2/1996 | Menegatto | 242/473.8 X |
| 5,566,904 | 10/1996 | Hashimoto | 242/474.7 X |
| 5,803,394 | 9/1998 | Kotzur et al. | 242/474.4 X |

FOREIGN PATENT DOCUMENTS

| | | |
|---|---|---|
| 0 690 018 A2 | 1/1996 | European Pat. Off. . |
| 886 319 | 10/1943 | France . |
| 2 312 609 | 10/1974 | Germany . |
| 41 21 325 A1 | 1/1992 | Germany . |
| 432 311 | 9/1967 | Switzerland . |
| 1 229 002 | 4/1971 | United Kingdom . |

*Primary Examiner*—Donald P. Walsh
*Assistant Examiner*—Collin A. Webb
*Attorney, Agent, or Firm*—Herbert Dubno

[57] ABSTRACT

In order to make possible an automatic replacement of full bobbins in a spooling device with continuous thread supply, the supplied thread from the traversing thread guide is lifted and directed to a cutting and suction device. The supplied thread is cut and sucked in. The full bobbin is allowed to roll away from the spooling position on inclined rolling rails. Through the rolling motion of the full bobbin the fall of an empty bobbin into the spooling position is triggered and the supplied thread is attached to the delivered empty bobbin. A device for carrying out this method has a movable thread guide rail, a thread cutting device, a thread suction nozzle, rolling rails for the full bobbin, inclined rails for the empty bobbin and a thread guiding arm which wraps the thread around the empty bobbin.

9 Claims, 6 Drawing Sheets

5
1
17
C
26
29
19
6
18
4
3
2
B 5
26
27
1
17
13
13
23
22
21
6
16
16
9
8
14
14
11
2
10

5
5'
1
27
13
27
1'
17
17
13
13
23
22
16
21
9
9
8
8
14
14
6
6'
11
2

DEVICE FOR AUTOMATICALLY REPLACING THREAD BOBBINS AND SPOOLING DEVICE WITH REPLACEMENT UNIT

SPECIFICATION

CROSS REFERENCE TO RELATED APPLICATIONS

This is a national stage of PCT/DE98/00946 filed Apr. 1, 1998 and based in turn on German national applications 197 13 848.9 of Apr. 4, 1997 and 198 02 413.4 of Jan. 23, 1998.

FIELD OF THE INVENTION

Our present invention relates to a method for automatically replacing peripherally driven thread bobbins on spooling devices of spinning machines for processing endlessly supplied textile threads and a spooling machine with a device by means of which the method can implemented.

BACKGROUND OF THE INVENTION

In such spinning machines full bobbins are removed as a rule while the machine operates in a so-called "random exchange", and are replaced by empty bobbins. Since the timing of the bobbin exchange and the bobbins which have to be replaced are largely determined at random, the machine has to be capable of carrying out this exchange automatically and at each spooling position, independently from other spooling positions. The resulting achieved advantage is the elimination of waiting time for the services of an operator or a robot. This again avoids standstill and loss of thread material when a bobbin is removed, or excessive length on the bobbins when they continue to run until they are replaced.

OBJECT OF THE INVENTION

It is the object of the invention to provide a spooling device with a replacement unit, by means of which a full bobbin can be automatically exchanged for an empty bobbin and for handling a continuously supplied thread.

SUMMARY OF THE INVENTION

The method of automatically replacing peripherally driven thread bobbins on spooling devices of a spinning machines for processing an endlessly supplied thread, according to the invention is characterized in that after a bobbin is full the supplied thread is guided towards a suction nozzle and a cutting device, whereby the supplied thread strand cut off by the cutting device is directed into the suction nozzle and the runoff strand is wound around the full bobbin. Then the full bobbin is released from its mounting and contact position at a drive roller and rolls on an inclined track from the winding position in a discharge position. Due to the motion of the full bobbin a prepared empty bobbin is released from its ready-to-use position to fall into the winding position in contact with the drive roller and into the mounting, where it is seized. The thread running in the suction nozzle is then wrapped around the empty bobbin by means of a thread-guiding element, and entraining the wrapped thread by the bobbin.

The spooling device on a spinning machine for processing endlessly supplied textile threads, works with a unit for automatically replacing thread bobbins which are mounted in a rotatable support and are peripherally driven by a drive roller against which they rest. The spooling device has the following components:

- a thread cutting device, which cuts off a supplied thread;
- a thread suction nozzle preceding the thread cutting device in the running direction of the thread, which takes up the oncoming strand of a cutoff thread;
- a mounting receiving a bobbin sleeve, which can be moved away from the drive roller;
- two inclined rolling guide rails guiding a full bobbin from a winding position to a discharge position;
- a depression holding a prepared empty bobbin in a ready-to-use position and releasing it;
- two fall guide rails, guiding an empty bobbin from its ready-to-use position to the winding position; and
- a movable thread guiding device, by means of which the thread running in the thread suction nozzle can be applied to an empty bobbin guided into the winding position.

With this device a process run is made possible, wherein separate successive steps can be automatically initiated and performed. So for instance the mere opening of the clamping jaws holding a full bobbin not only releases the bobbin, but in addition the full bobbin rolls automatically out of the spooling position into a discharge position, thereby causing with its motion, the release of the empty bobbin from its ready-to-use position, which subsequently falls by itself into the spooling position. Therefore neither a separate actuation element, which brings the empty bobbin to its spooling position, nor a sensor which detects the disengagement of the spooling location and then releases the empty bobbin is required.

The rolling guide rails and the fall guide rails can have common tiltable rail pieces, which under the action of a spring are pressed into the trajectory of the fall guide rails and by the weight of a full bobbin rolling away on the rolling guide rails can be pressed into the trajectory of the fall guide rails.

A two-winged flap 19 can be provided, by means of which a full bobbin rolling away on the rolling guide rails can be swung, thereby lifting an empty sleeve from the ready-to-use position in the depression and guiding it towards the fall guide rails inclined towards winding position. The thread cutting device, the thread suction nozzle and the thread guide rails can be arranged on a common slide displaceable by means of an actuation element.

The thread guiding device can have a stationary, pivotable supported thread guiding arm swingable by means of an actuation element, with a thread guiding arm provided with a thread guiding pin.

The guide rail can have a thread applying slide supported slidably by means of an actuation element, at whose end a thread guiding lever is supported, which carries the thread guiding device and which by tilting down the thread applying slide by means of coupling elements is swingable in order to position the thread guiding device on the empty bobbin, guided into the winding position.

A thread cutting device can be assigned to the thread guiding lever. In general automatically operating thread cutting devices are provided through which the thread can run unimpeded in the one running direction and wherein in the opposite running direction it is clamped and cut.

Each thread cutting device can consist of an anvil and a blade resting against it. The spooling device can have several winding heads with which at the same time several bobbins arranged coaxially can be wound. The work elements directly assigned to the bobbins or sleeves, such as jaws, rolling guide rails, inclined guide rails, thread cutting device, thread suction nozzle and thread guiding rail are provided for each winding head.

Due to the fact that the swingable rail segments are automatically pressed into the trajectory of the rolling guide rails by the full bobbin which is rolling away, and the under spring action also automatically return into the path of the fall guide rails, an actuation element for this displacement of the swingable rail segments can also be eliminated.

Also the arrangement of the thread cutting device, of the thread suction nozzle and of the thread guiding rail on a common slide offers the advantage of requiring only a single actuation element for the functionally correct displacement of these working elements.

The components of the bobbin replacement device of the invention require so little space laterally, in the direction of the of the neighboring spooling devices, that it can be accommodated not only in the separating space available in normal spooling devices without automatic replacement unit, but can be made also as a replacement unit for multiple spooling devices.

The thread guiding device can be arranged on a slide which can be displaced in the direction of the winding head. This offers the advantage that, during a normal run, the thread guiding device can be retracted from the area of the spooling device and does not impede its operation.

In a first embodiment, the thread guiding device is designed as a lever arm swingable in the mentioned slide about a horizontal axis, at whose free end a thread guiding pin is arranged, which guides the thread in a functionally correct manner.

When the thread guiding device is executed as in a further development of the invention the thread to be attached to the bobbin is introduced in a thread gripping groove against the running direction of the latter, thereby being securely seized and entrained.

BRIEF DESCRIPTION OF THE DRAWING

The above and other objects, features, and advantages will become more readily apparent from the following description, reference being made to the accompanying drawing in which:

FIG. 2 is a side view of the spooling device of FIG. 1 when a full bobbin is discharged and an empty bobbin is brought in;

SPECIFIC DESCRIPTION

Description of a First Embodiment of the Device

Figure 1:
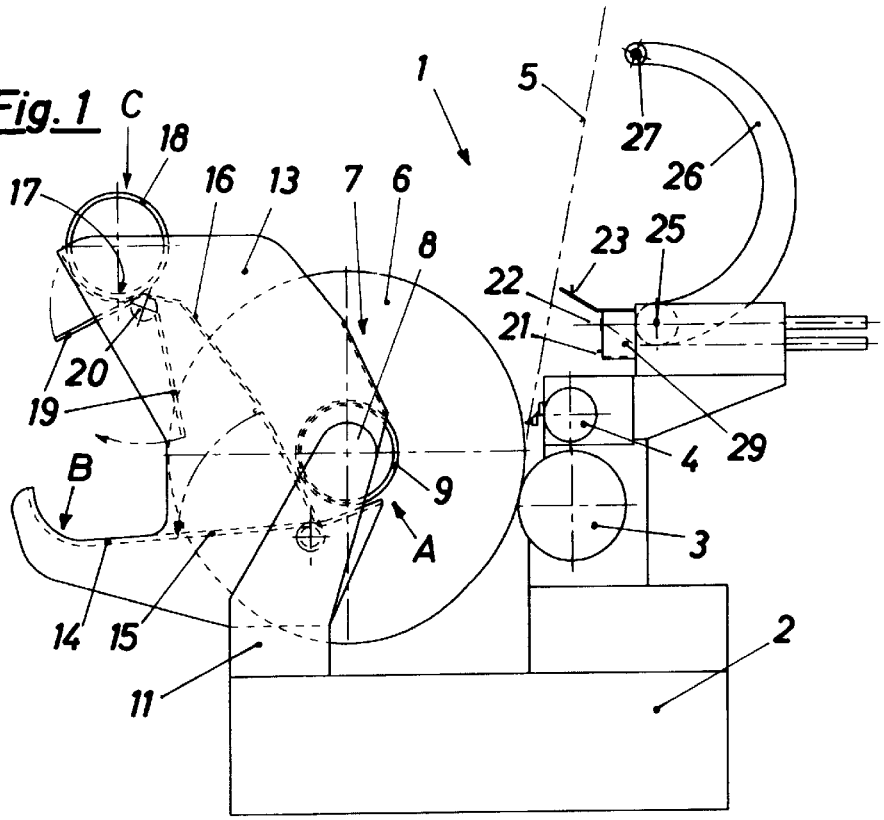
FIG. 1 is a side view of a first embodiment of the spooling device when it reaches the state of full bobbins.

As can be seen from FIG. 1, the spooling device 1 has a support body 2, mounted on a machine frame which here is not described in greater detail, a rotationally driven roller 3 and a traversing thread guide 4, which guide a supplied thread 5 back and forth over the width of a bobbin 6. The bobbin 6 is rotatably supported in mounting 7. This mounting 7 has two jaws 8, which clamp the sleeve 9 of the bobbin 6 at both ends. The jaws 8 can be moved to clamp or release the sleeve 9 by actuating means 10 which are merely indicated in FIG. 4, and which can be either a motor or a hydraulic or electromagnetic working element. The mounting 7 of the bobbin 6 is arranged in a slide 11, which can be moved back and forth in the support body 2, by means of an actuation element 12 merely indicated in FIG. 2, e.g. a motor or a hydraulic or electromagnetic working element.

Figure 4:
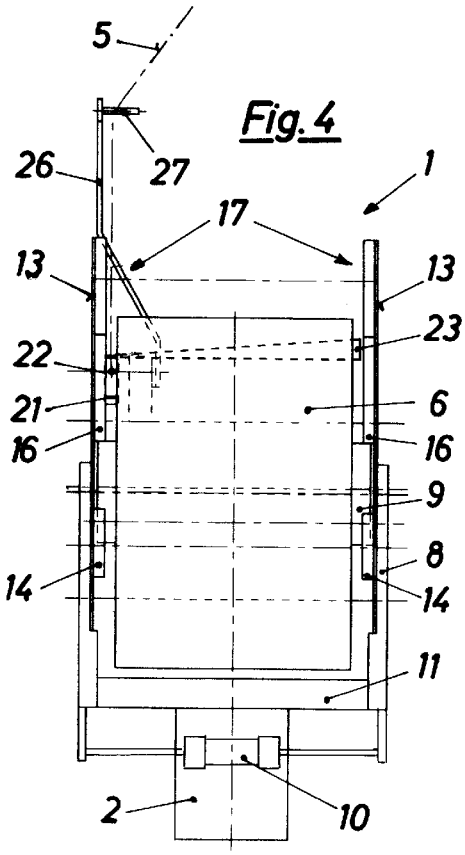
FIG. 4 is a front view of the spooling device of FIG. 1.

As can be seen especially in FIG. 4, between the jaws 8 on lateral cheeks 13 two narrow, downwardly inclined rolling guide rails 14, are arranged starting from the winding position A, upon which can rest the ends of the sleeve 9 which project beyond the wound thread of bobbin 6. The rolling guide rails 14 end in a discharge position B for the full bobbin 6. Each of the rolling guide rails 14 has a tiltable rail piece 15, which under the action of a spring which is not shown in detail can be pushed in upwardly tilted position. This action is represented by a clockwise arrow in FIG. 2 and hence the piece 15 is "spring loaded."

In the upwardly tilted position, the rail pieces 15 form segments of the fall guide rails 16, which lead from a depression 17 of a ready-to-use position C for an empty bobbin 18 to the winding position A. In the area of the depression 17, between the fall guide rails 16, a two-winged flap 19 is freely swingable about an axis 20.

Figure 2:
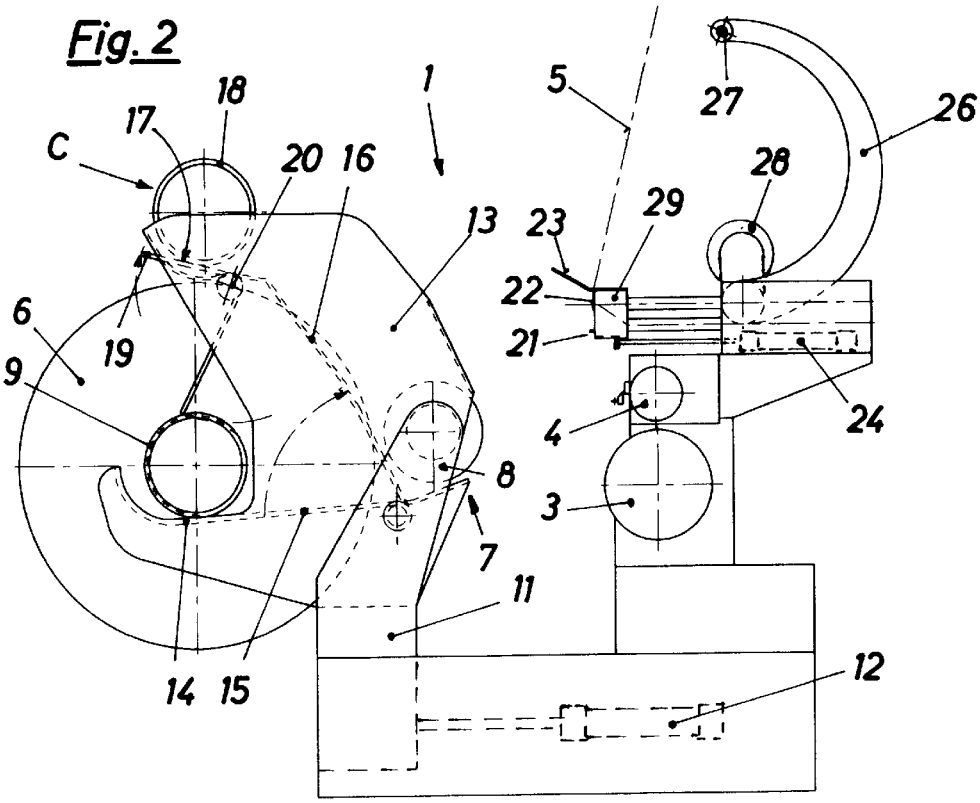

Further in the support body 2 a thread slide 29 is guided so that it can slide back and forth by means of an actuation element which is not shown, e.g. in the form of a piston/cylinder unit, on which the provided thread cutting device 21 not shown in all details, the thread suction nozzle 22 and a thread guiding rail 23, by means of an actuation element 24 shown only in FIG. 2, e.g. a motor or a hydraulic or electromagnetic working element, are brought within the range of a supplied thread 5. The thread suction nozzle 22 is connected to an underpressure, by means of a valve in a manner not shown in the drawing.

Further on the support body 2 a thread guiding arm 26, swingable about an axis 25 is arranged, which at its free end has a transverse, short thread guiding pin 27 extending over the cutting device 21 and the thread suction nozzle 22, and which is also automatically movable by an actuation element 28 shown only in FIG. 2.

There is also a control unit not shown in the drawing, which is connected with the mentioned actuation elements 10, 12, 24 and 28, optionally also with sensors for detecting the position of the working elements and their coordinated, functionally correct actuation.

Description of the Operation of the First Embodiment

When the bobbin 6 is full, i.e. when the predetermined length of thread has been wound on it, which for instance can be established by a length measuring device not shown in the drawing, a signal is given to the control unit to initiate the exchange process. This situation is shown in FIG. 1. For this purpose at first the thread guiding rails 23, the thread cutting device 21 and the thread suction nozzle 22 are pushed forward by the actuation element 24 into the path of the thread 5. The thread guiding rail is inclined so that it lifts the supplied thread 5 from the traversing thread guide 4 and leads it to the thread cutting device 21 and the thread suction nozzle 22 arranged laterally with respect to the bobbin 6. The thread is cut in the thread cutting device 21 and the rest of the oncoming supplied thread is aspired and sucked in by the thread suction nozzle 22. The other end of the thread 5 is wound onto the bobbin 6.

Then the jaws 8 are opened by the actuation element 10, releasing the sleeve 9 of the full bobbin 6, thereby releasing the bobbin. The sleeve 9 of the bobbin 6 comes to lie on the rolling guide rails 14, and due to their inclination rolls away from the drive roller 3 in the direction of the discharge position B. This presses the tiltable rail piece 15 downwards, so that it can pass underneath the fall guide rails 16, while it also forms the end of the trajectory the rolling guide rails 14.

In the further course of its rolling motion, the sleeve 9 of the full bobbin 6 displaces the flap 19 by impact on its lower arm and lifts with its other arm the prepared empty bobbin sleene 18 from its ready-to-use position C in the depression 17 (this situation is shown in FIG. 2) and allows the empty bobbin sleene to pass over the fall guide rails 16 into the winding position A. The motion of the fall guide rails 16 is again concluded after the passage of the full bobbin on the downwards titled rail pieces 15, due to the upswing of the rail pieces.

When the empty bobbin 18 has reached the winding position A, the jaws 8 are closed again, thereby seizing the sleeve. Then the slide 10 is retracted due to the actuation by the actuation element 12, and the sleeve 18 is positioned against the drive roller 3 and set to rotate.

Figure 3:
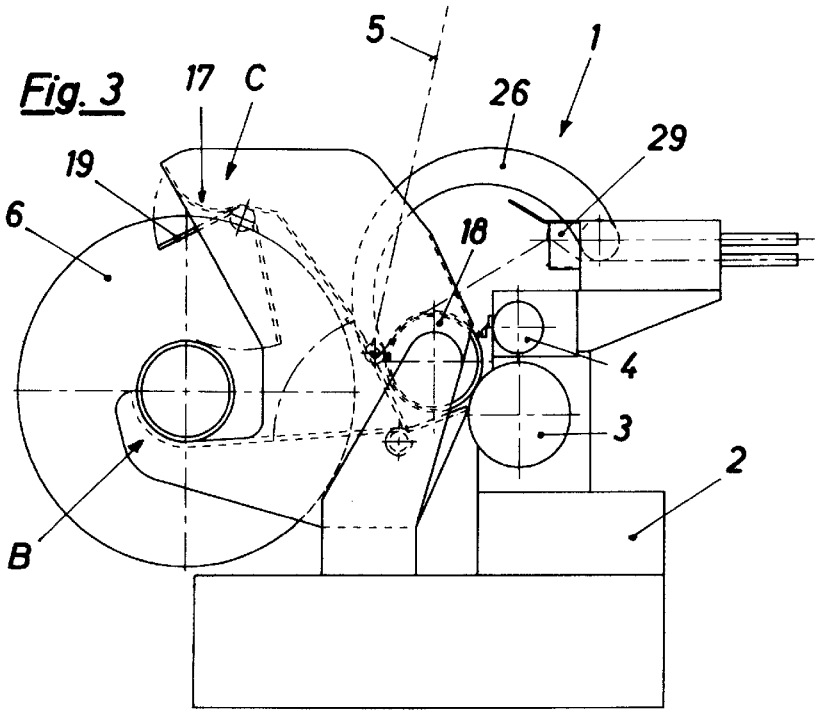
FIG. 3 is a side view of the spooling device of FIG. 1 when the thread is attached to the empty bobbin.

Due to the actuation element 28 the thread guiding arm 26 is now swung downwards and at the same time the thread cutting device 21 and the thread suction nozzle 22 are retracted by the actuation element 24. During its swinging motion, the thread guiding pin 27 of the thread guiding arm 26 seizes the thread running in the thread suction nozzle 22 and wraps it around the empty bobbin 18—this situation is shown in FIG. 3. Advantageously the empty bobbin 18 has at its ends a thread catching groove, which is known per se and therefore not closer illustrated here, into which the thread enters and is entrained in the rotation of the sleeve, i.e. is wound thereupon. When the thread guiding arm 26 swings back—and since the thread cutting device 21, the thread suction nozzle 22 and the thread guiding rail 23 have been retracted—it comes into the effective range of the traversing thread guide 4, at which point the winding process is resumed.

Figure 5:
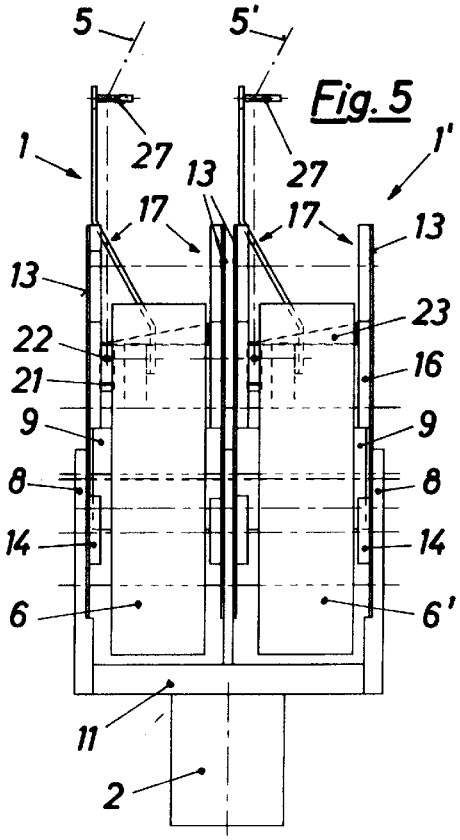
FIG. 5 is a front view of the spooling device corresponding to FIGS. 1 to 4 with two bobbins.

FIG. 5 shows an embodiment of the invention for the winding of two, respectively double-wound processed threads 5 and 5' onto two narrow bobbins 6 and 6' formed in a spooling device 1'. Here the working elements directly assigned to the individual bobbins 6 and 6' are present in two sets, in order to be able to service the two threads 5, 5', the two bobbins 6, 6' and the two empty bobbins not shown in the drawing in a synchronized manner during the replacement process. Since the working elements are synchronously actuated during the replacement process, it is possible for the actuation elements to commonly actuate working elements of the same kind, and therefore only a single set can be provided. Otherwise the course of the replacement process is the same as described before.

At the winding position A a sensor, not shown in greater detail in the drawing, for instance in the form of a photoelectric barrier, connected to a control unit can be arranged, which detects the presence of an empty bobbin 18 and only in this case trigger the closing of the jaws 8 via the control unit not shown in the drawing.

Description of a Second Embodiment of the Device

In the embodiment of the spooling device according to FIG. 6 to 10, the thread slide 29 of the embodiment according to FIGS. 1 to 5 is subdivided into a thread cutting slide 30 and a thread applying slide 31, which can be separately actuated and act one after the other.

Figure 6:
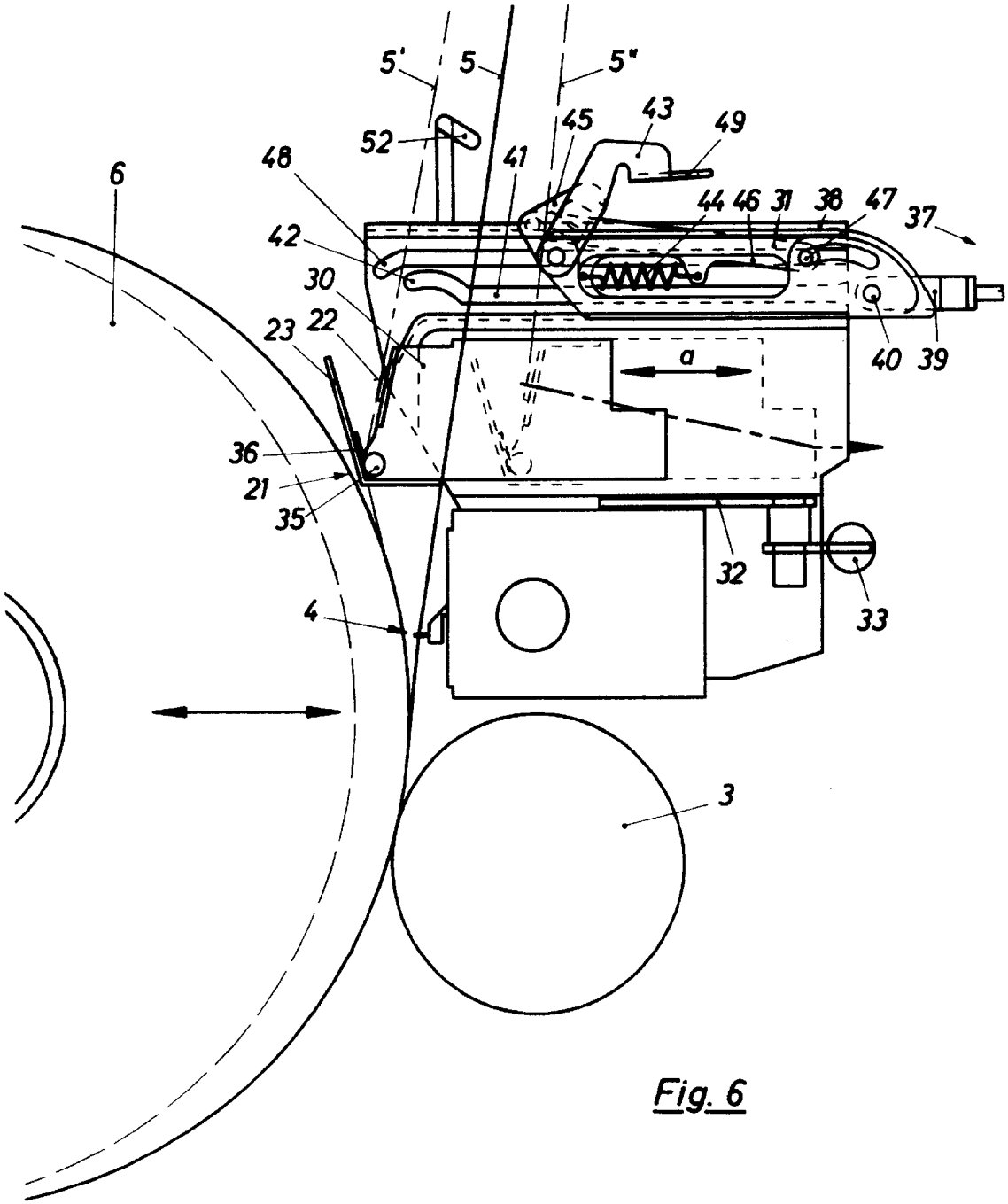
FIG. 6 is a side view of a second embodiment of the spooling device when the thread is cut off.
Figure 7:
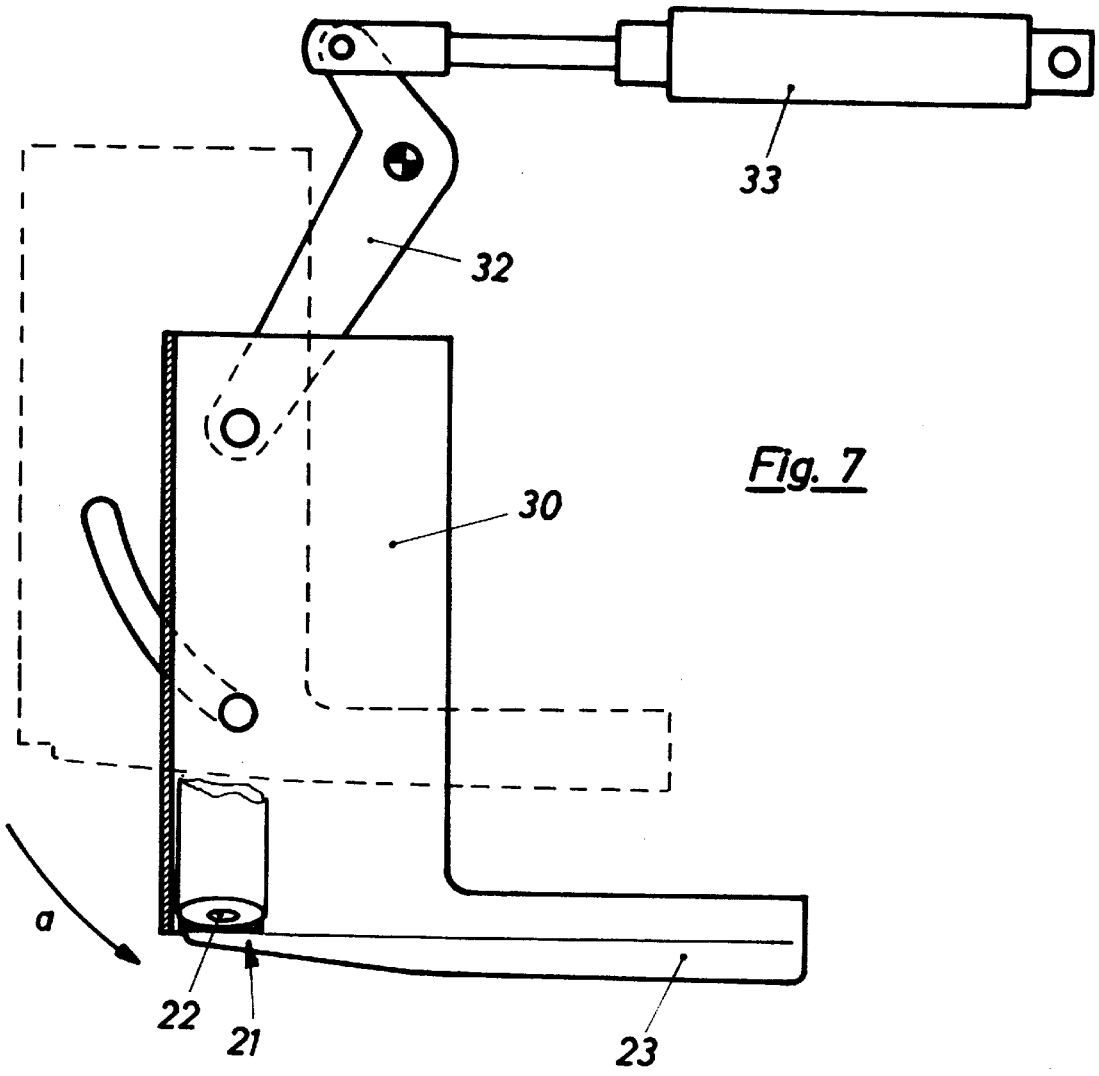
FIG. 7 is a top view of the mechanism moving the thread cutting slide.

The thread cutting slide 30—as shown in FIG. 7—affixed on an angled double-armed swivel lever 32 rotatable about a vertical axis by means of an actuation element 33, e.g. in the form of a piston cylinder unit, can be moved from its rest position shown in broken lines in FIGS. 6 and 7 in the direction of arrow a to its working position shown in solid lines, forwards and inwards towards the median plane of the spooling device. The already previously described working elements thread cutting device 21, thread suction nozzle 22 and thread guiding rail 23 are arranged on this thread cutting device 30. As can be seen, the thread cutting device consists here of a bolt-shaped anvil 35 and a blade 36 slightly resting thereon. By means of this thread cutting device 21 the thread 5 can pass through without difficulty in the running direction in which the blade 36 is resting on the anvil 35, in the other running direction the thread pulls the blade against the anvil and is cut.

Figure 10:
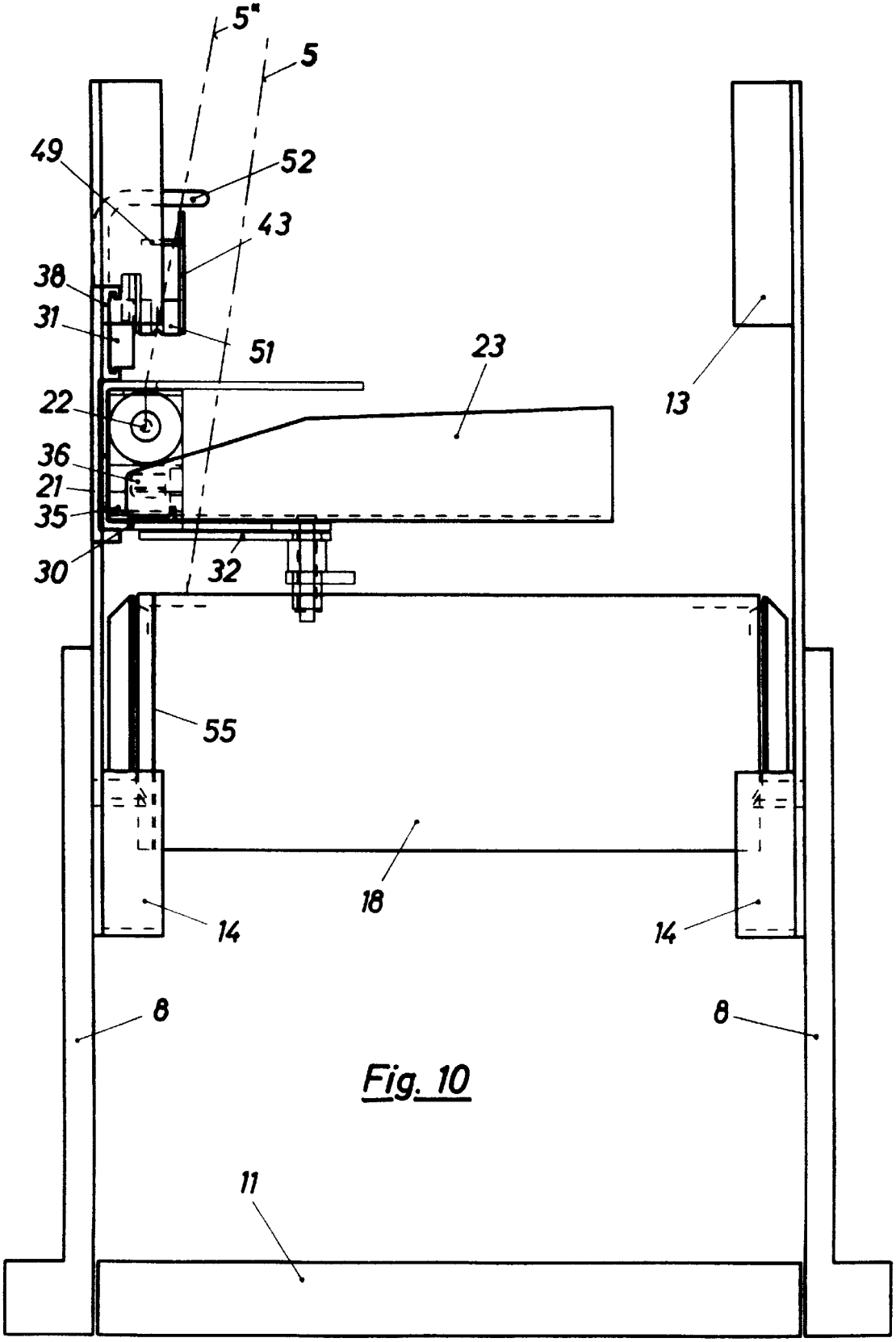
FIG. 10 is a front view of the spooling device of FIG. 4.

By means of an actuating element 37, e.g. in the form of a piston cylinder unit 37 not shown in the drawing, the thread applying slide 31 is slidable in the direction of arrow b in a guide rail 38, which has an upper and a lower runner guiding the thread applying slide 31, and which—as can be seen in FIG. 10—is arranged above the thread cutting slide 30 in its outwardly swung position. The piston rod 39 of the actuation means 37 engages with its pin 40 at the thread applying slide 31. This pin 40 slides in a coulisse 41 which in its end zone 42 is curved and closed.

Figure 8:
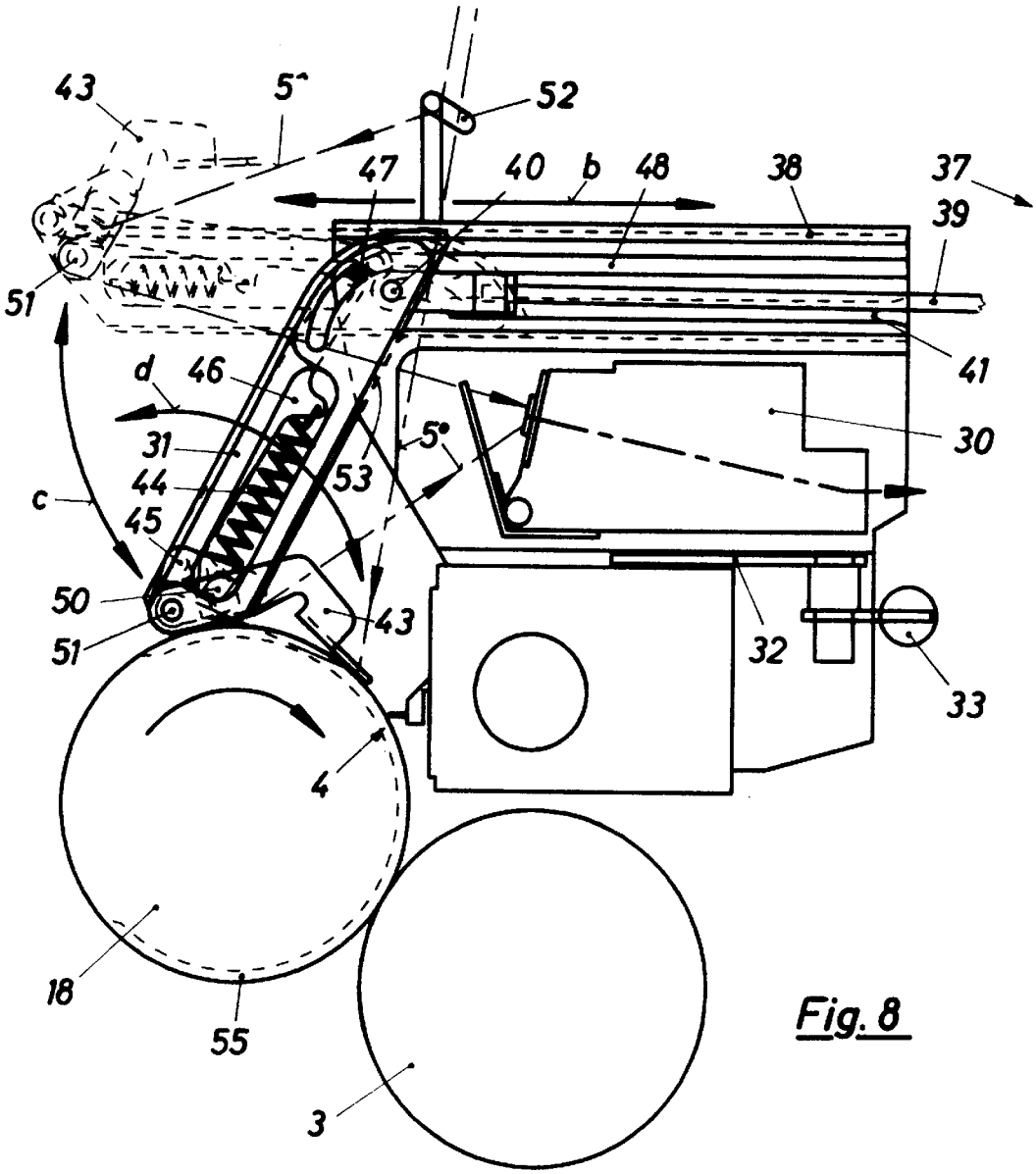
FIG. 8 is a side view of the spooling device of FIG. 6 when the thread is attached to the empty bobbin.
Figure 9:
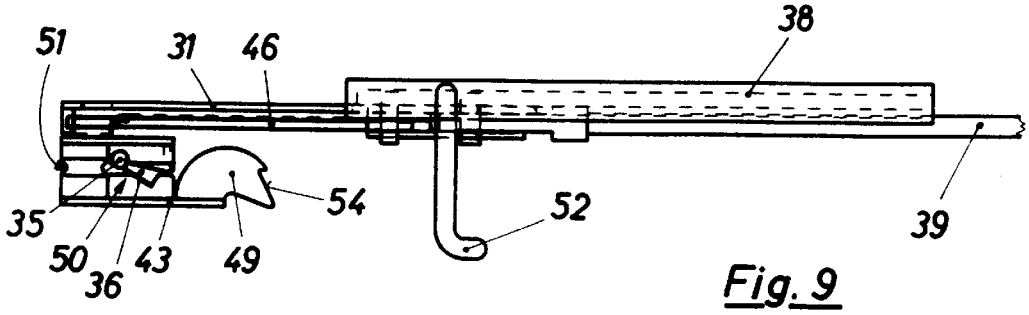
FIG. 9 is a top view of the thread attaching device.

On the frontal end of the thread applying slide 31, a thread guiding lever 43 is pivotally supported, which in its rest position is pressed by a spring 44 in the position shown in broken lines in FIGS. 6 and 8. The thread guiding lever 43 is connected with a crank arm 45, wherein a traction rod 46 engages, whose other end engages with a pin 47 in a coulisse 48 in the guide rail 38. On the thread guiding lever 43 a thread guiding plate 49 is arranged, whose contour is visible in FIG. 9, and a thread cutting device 50, which can be designed correspondingly to the thread cutting device 21.

Description of the Operation of the Second Embodiment

When the bobbin 6 is full, at first due to the actuation of its actuating element 33, the thread cutting slide 30 is moved forwards and inwards according to arrow a to its working position in the area of the transversely moving thread 5—FIGS. 6 and 7. Thereby the thread guiding rail 23 lifts the thread 5 out of the traversing thread guide 4 and guides it laterally in front of the thread suction nozzle 22 and to the thread cutting device 21, which at the given running direction of the thread is not yet effective. The thread 5 assumes now the running path 5'.

As soon as the full bobbin is lifted from the drive roller 3 and slowed down as described before (FIG. 6 in broken lines), the tensile stress in the thread 5 breaks down and it is pulled into the thread suction nozzle 22. Thereby its running direction through the thread cutting device 21 reverses, it pulls the blade 36 against the anvil 35 and clamps itself and/or cuts itself off. An end of the thread is wound onto the bobbin 6, the other end, namely the continuously oncoming thread 5 is sucked into the thread suction nozzle 22. Subsequently the thread cutting slide 30 is again swung outwards and back, whereby the thread 5 assume the thread path 5", which—as can be seen from FIG. 10—lies in front of the thread applying slide 31.

As previously described, an empty bobbin 18 falls now into the place of the rolled-away full thread bobbin 6.

As shown in FIG. 8, after that the thread applying slide 31 is pushed forward from its rest position and into an intermediate position shown in broken lines through the actuation of the actuation element 37. The thread 5 running in the thread suction nozzle 22 is ejected in hair-pin-like manner into the thread path 5^, by means of the support bolt 51 provided with a thread groove of the thread guiding lever 43 and of a stationary thread guide 52. As soon as the pin 40 on the thread applying slide 31 moves in the curved end area 42 (FIG. 6) of the coulisse 41, the thread applying slide is swung downward around the angled edge of the lower runner 53 of the guide rail 38 wrapped around the angled edge of the lower runner in the direction of arrow c into its working position shown in full lines.

Since the bolt 47 on the traction rod 46 comes to lie against the end of the coulisse 48 on the guide rail 38, the thread guiding lever 43 is swung in the direction of arrow d, whereby its thread guiding plate 49 seizes the thread 5 in the upper part of the thread path 5^ ejected in a hair-pin-like manner and takes it along. The bevelled leading edge 54 of the thread guiding plate 49 thereby leads the two thread ends crossing each other. At the same time the thread 5 is inserted in the thread cutting device 50, which however, because of the given running direction of the thread indicated by arrows in the present thread running path 5°, is not effective in the thread suction nozzle 22.

In the end position of the thread guiding slide 30 and the thread guiding lever 43 indicated in full lines, the thread is pressed between the support bolt 51 of the thread guiding lever 43 and the thread guiding plate 49 into a thread catching groove 55 arranged in the empty bobbin 18, whereby it is seized and entrained.

As soon as the thread 5 is seized by the thread catching groove 55 and entrained in the rotation direction of the empty bobbin 18, its running direction reverses, i.e. it is pulled out of the thread suction nozzle 22. As a result the thread cutting device 50 is triggered and cuts the thread 5. The rest of the thread is pulled into the thread suction nozzle 22, the supplied thread is seized by the traversing thread guide 4 and wound onto the new empty bobbin 18 through transfer. This way the bobbin replacement is carried out and the thread applying slide 31 and the thread guiding lever 43 can again be swung back, respectively retracted, into their rest position.

It is self-understood that the embodiment of FIGS. 6 to 10 can also be provided on spooling devices working with a double twist according to FIG. 5.

What is claimed is:

1. A method of automatically replacing a peripherally driven thread bobbin on a spooling device of a spinning machine for processing an endlessly supplied thread, said method comprising the steps of:

(a) after a bobbin is full, guiding the supplied thread towards a suction nozzle and a cutting device, whereby the supplied thread strand is cut off by the cutting device is directed into the suction nozzle and a runoff strand is wound around the full bobbin;

(b) then releasing the full bobbin from a mounting and contact location at a drive roller and causing the released full bobbin to roll on an inclined track from a winding position to a discharge position;

(c) by the motion of the full bobbin releasing a prepared empty bobbin from a ready-to-use position to fall into the winding position in contact with the drive roller and into the mounting, where the empty bobbin is seized; and (d) then wrapping the thread running in the suction nozzle is wrapped around the empty bobbin by means of a thread-guiding element, and entraining the wrapped thread by the bobbin.

2. A spooling device on spinning machines for processing endlessly supplied textile threads, with a unit for automatically replacing thread bobbins which are mounted in a rotatable support and are peripherally driven by a drive roller against which they rest, the spooling device (1) comprising:

a thread cutting device (21), which cuts off a supplied thread (5);

a thread suction nozzle (22) preceding the thread cutting device (21) in the running direction of the thread, which takes up the oncoming strand of a cutoff thread (5);

a mounting (7) receiving a bobbin sleeve (9, 9'), which can be moved away from the drive roller (3) and on which a full bobbin can be wound;

two inclined rolling guide rails (14) guiding a full bobbin (6) from a winding position (A) to a discharge position (B);

a depression (17) holding a prepared empty bobbin (18) in a ready-to-use position (C) and releasing it;

two fall guide rails (16), guiding an empty bobbin (18) from its ready-to-use position (C) to the winding position (A); and a movable thread guiding device (26, 27; 31, 43, 49), by means of which the thread (5) running in the thread suction nozzle (22) can be applied to an empty bobbin (18) guided into the winding position (A) the rolling guide rails (14) and the fall guide rails (16) having common tiltable spring-loaded rail pieces (15), which are pressed into the trajectory of the fall guide rails and by the weight of a full bobbin (6) rolling away on the rolling guide rails can be pressed into the trajectory of the rolling guide rails, a two-winged flap 19 being provided which is swung by a full bobbin (6) rolling away on the rolling guide rails (14), thereby lifting an empty sleeve (9) from the ready-to-use position (B) in the depression (17) and guiding it towards the fall guide rails (16) inclined towards winding position (A).

3. The spooling device according to claim 2 wherein a thread cutting device (21), a thread suction nozzle (22) and a thread guide rail (23) are arranged on a common slide displaceable by means of an actuation element (24).

4. The spooling device according to claim 2 wherein the thread guiding device has a stationary, pivotable supported thread guiding arm (26) swingable by means of an actuation element (28), with a thread guiding arm (26) provided with a thread guiding pin (27) which feeds the thread into a crevice between the bobbin and said roller.

5. The spooling device according to claim 2, wherein a guide rail (38) wherein thread applying slide (31) is supported slidably by means of an actuation element (37), at whose end a thread guiding lever (43) is supported, which carries the thread guiding device (49) and which by tilting down the thread applying slide by means of coupling elements (46, 47) is swingable in order to position the thread guiding device on the empty bobbin (18), guided into the winding position (A).

6. The spooling device according to claim 5, wherein a thread cutting device (50) is assigned to the thread guiding lever (43).

7. The spooling device according to claim 5 wherein an automatically operating thread cutting devices (50) is provided through which the thread can run unimpeded in the one running direction and wherein in the opposite running direction it is clamped and cut.

8. The spooling device according to claim 7 wherein the thread cutting device (50) consists of an anvil (35) and a blade (36) resting against it.

9. The spooling device according to claim 2, with several winding heads, wherein at the same time several bobbins arranged coaxially can be wound, wherein work elements directly assigned to the bobbins (6, 6'), respectively sleeves (9, 9'), including clamping jaws (8), rolling guide rails (14), fall guide rails (16), a thread cutting device (21), a thread suction nozzle (22), and a thread guiding rail (23) are provided for each winding head.

* * * * *